United States Patent [19]

Shimizu et al.

[11] Patent Number: 5,000,669

[45] Date of Patent: Mar. 19, 1991

[54] HERMETIC SCROLL TYPE COMPRESSOR HAVING TWO SECTION CHAMBERS LINKED BY INCLINED OIL PASSAGE

[75] Inventors: Shigemi Shimizu, Sakai; Kazuto Kikuchi, Honjo, both of Japan

[73] Assignee: Sanden Corporation, Gunma, Japan

[21] Appl. No.: 461,298

[22] Filed: Jan. 5, 1990

Related U.S. Application Data

[62] Division of Ser. No. 240,627, Sep. 6, 1988, Pat. No. 4,936,756.

[30] Foreign Application Priority Data

Sep. 8, 1987 [JP] Japan ..... 62-223080
Sep. 8, 1987 [JP] Japan ..... 62-223081

[51] Int. Cl.[5] ..... F04C 18/04; F04C 29/02

[52] U.S. Cl. ..... 418/1; 418/55.6; 418/DIG. 1

[58] Field of Search ..... 418/55 E, 94, 100, DIG. 1, 418/1; 184/6.16

[56] References Cited

U.S. PATENT DOCUMENTS

| | | | |
|---|---|---|---|
| 3,317,123 | 5/1967 | Funke . | |
| 3,884,599 | 5/1975 | Young et al. | 418/55 |
| 3,899,271 | 8/1975 | Glanvall | 418/82 |
| 3,945,765 | 3/1976 | Toyoda et al. | 417/269 |
| 4,005,948 | 2/1977 | Hiraga et al. | 417/269 |
| 4,303,379 | 12/1981 | Hiraga et al. | 418/55 |
| 4,314,796 | 2/1982 | Terauchi | 417/294 |
| 4,332,535 | 6/1982 | Terauchi et al. | 418/94 |
| 4,340,339 | 7/1982 | Hiraga et al. | 418/88 |
| 4,343,599 | 8/1982 | Kousokabe | 418/88 |
| 4,365,941 | 12/1982 | Tojo et al. | 417/372 |
| 4,484,869 | 11/1984 | Nakayama et al. | 418/55 E |
| 4,496,293 | 1/1985 | Nakamura et al. | 417/371 |
| 4,527,963 | 7/1985 | Terauchi | 418/100 |
| 4,538,975 | 9/1985 | Tsukagoshi | 418/DIG. 1 |
| 4,547,138 | 10/1985 | Mabe et al. | 418/91 |
| 4,560,330 | 12/1985 | Murayama et al. | 417/410 |
| 4,564,339 | 1/1986 | Nakamura et al. | 417/366 |
| 4,666,381 | 5/1987 | Butterworth | 418/88 |
| 4,767,293 | 8/1988 | Caillat et al. | 418/57 |
| 4,900,238 | 2/1990 | Shigemi et al. | 417/410 |

FOREIGN PATENT DOCUMENTS

| | | | |
|---|---|---|---|
| 141052 | 3/1935 | Austria . | |
| 317900 | 11/1988 | European Pat. Off. . | |
| 1171448 | 11/1960 | Fed. Rep. of Germany . | |
| 58-165589 | 9/1983 | Japan . | |
| 58-172487 | 10/1983 | Japan . | |
| 59-110883 | 6/1984 | Japan . | |
| 60-93192 | 5/1985 | Japan . | |
| 61-87994 | 5/1986 | Japan . | |
| 61-205386 | 9/1986 | Japan . | |
| 61-212689 | 9/1986 | Japan | 418/55 E |
| 61-265380 | 11/1986 | Japan . | |
| 61-291793 | 12/1986 | Japan . | |
| 62-58094 | 3/1987 | Japan . | |
| 62-113881 | 5/1987 | Japan . | |

*Primary Examiner*—John J. Vrablik
*Attorney, Agent, or Firm*—Banner, Birch, McKie & Beckett

[57] ABSTRACT

This invention discloses a lubricating mechanism of a hermetically sealed scroll type compressor in which an inner chamber of a housing is kept at suction pressure. The compressor includes a drive shaft supported by bearings in inner blocks. The drive shaft is operatively linked to an orbiting scroll which orbits within a stationary scroll. A rotation prevention device prevents rotation of the orbiting scroll. The drive shaft includes an axial bore extending from an open end and terminating adjacent a forward bearing. A pin extends from the end of the drive shaft to the orbital scroll. A passage links the axial bore to an opening at the end of the pin facing the orbital scroll. Radial bores are provided near the terminal end of the axial bore and at the rearward end of the axial bore near a rearward bearing. The radial bores link the axial bore to a suction chamber of the compressor to allow lubricating oil to lubricate the bearings. The narrow passages allows lubrication of the rotation prevention mechanism. In a second embodiment the suction chamber is divided into two sections by a partition wall. An inclined passage links the two sections to allow the lubricating oil to flow.

11 Claims, 3 Drawing Sheets

HERMETIC SCROLL TYPE COMPRESSOR HAVING TWO SECTION CHAMBERS LINKED BY INCLINED OIL PASSAGE

This application is a division of application Ser. No. 07/240,627, filed Sept. 6, 1988, now U.S. Pat. No. 4,936,756.

BACKGROUND OF THE INVENTION

1. Field of the Invention

This invention relates to a scroll type compressor, and more particularly, to a lubricating mechanism for a hermetically sealed scroll type compressor.

2. Description of the Prior Art

A hermetically sealed scroll type compressor is disclosed in Japanese Patent Application Publication No. 61-87994 and is shown in FIG. 1. A hermetically sealed housing includes inner chamber 1 which is maintained at discharge pressure. However, the compression mechanism including interfitting scrolls 2 and 3 and the forward end of the drive mechanism are isolated from inner chamber 1 behind partition 4. Channel 5 links intermediate pocket 6 of the interfitting scrolls with chamber 7. Refrigerant gas flows through inlet port 8 and is compressed inwardly by the scrolls towards central pocket 9, and flows to discharge chamber 12 through hole 10 and eventually outlet port 11 to an external element of the refrigeration system. Some of the refrigerant gas also flows to inner chamber 1.

The intermediate pressure in pocket 6 is maintained in chamber 7 which contains the forward end of the drive mechanism including bearings 14–16. When the compressor operates, lubricating oil mixed with the refrigerant gas, which settles at the bottom of inner chamber 1, flows through channel 13 to lubricate bearings 14–16 of the drive mechanism due to the pressure difference between inner chamber 1, which is maintained at the discharge pressure, and the intermediate pressure.

However, it is difficult to utilize the above type of lubricating mechanism in a hermetically sealed scroll type compressor in which the inner chamber is maintained at the suction pressure. Since the suction pressure is lower than the discharge pressure and the intermediate pressure, the lubricating fluid will not flow to the drive mechanism in this type of compressor.

SUMMARY OF THE INVENTION

It is a primary object of this invention to provide an effective and simplified lubricating mechanism for use in a hermetically sealed scroll type compressor in which an inner chamber of the hermetically sealed housing is maintained at suction pressure.

A compressor according to this invention includes a fixed scroll and an orbiting scroll disposed within a hermetically sealed housing. The fixed scroll includes an end plate from which a first wrap or spiral element extends into the interior of the housing. The end plate of the fixed scroll divides the housing into a discharge chamber and a suction chamber. The first spiral element is located in the suction chamber. An orbiting scroll includes an end plate from which a second wrap or spiral element extends. The first and second spiral elements interfit at an angular and radial offset to form a plurality of line contacts which define at least one pair of sealed off fluid pockets.

A drive mechanism includes a motor supported in the housing. The drive mechanism is operatively connected to the orbiting scroll to effect orbital motion thereof. A rotation prevention device prevents the rotation of the orbital scroll during orbital motion so that the volume of the fluid pockets changes to compress the fluid in the pockets inwardly from the outermost pocket towards the central pocket. The compressed gas flows out of the central pocket through a channel in the end plate of the fixed scroll and into a discharge chamber.

The drive mechanism includes a drive shaft supported at both ends by bearings and having an axial bore linked to at least one radial bore leading to the suction chamber. One end of the drive shaft includes the open end of the axial bore and is located in close proximity to the inlet of the compressor. The other side of the drive shaft extends into a projecting pin forward of the location where the axial bore terminates within the drive shaft. The terminal end of the axial bore is linked to the projecting pin by an offset channel which opens into a chamber adjacent the end plate of the orbiting scroll. The projecting pin extends through a bushing in this chamber. A further radial bore may be located near the open end of the axial bore of the drive shaft.

In operation, the refrigerant gas includes a lubricating fluid which flows from the axial bore towards the radial bores and the offset channel. The fluid lubricates the bearings supporting the drive shaft as well as a rotation prevention mechanism located at the forward end of the drive shaft.

In a second embodiment, the suction chamber is divided into first and second suction chamber sections by a partition wall. The partition wall completely isolates the two chamber sections with the exception of an inclined bore located below and near the forward end of the drive shaft. Lubricant fluid settles at the bottom of the first section. The forward end of the drive shaft including the projecting pin, and the scrolls, are located in the second section of the suction chamber. In operation, the first section of the suction chamber is maintained at a higher pressure than the second section causing the fluid to flow upwardly through the inclined bore to lubricate the rotation prevention device and the forward bearing of the drive shaft.

Further objects, features and other aspects of this invention will be understood from the detailed description of the preferred embodiments of this invention with reference to the annexed drawings.

DETAILED DESCRIPTION OF THE PREFERRED EMBODIMENTS

Figure 1:
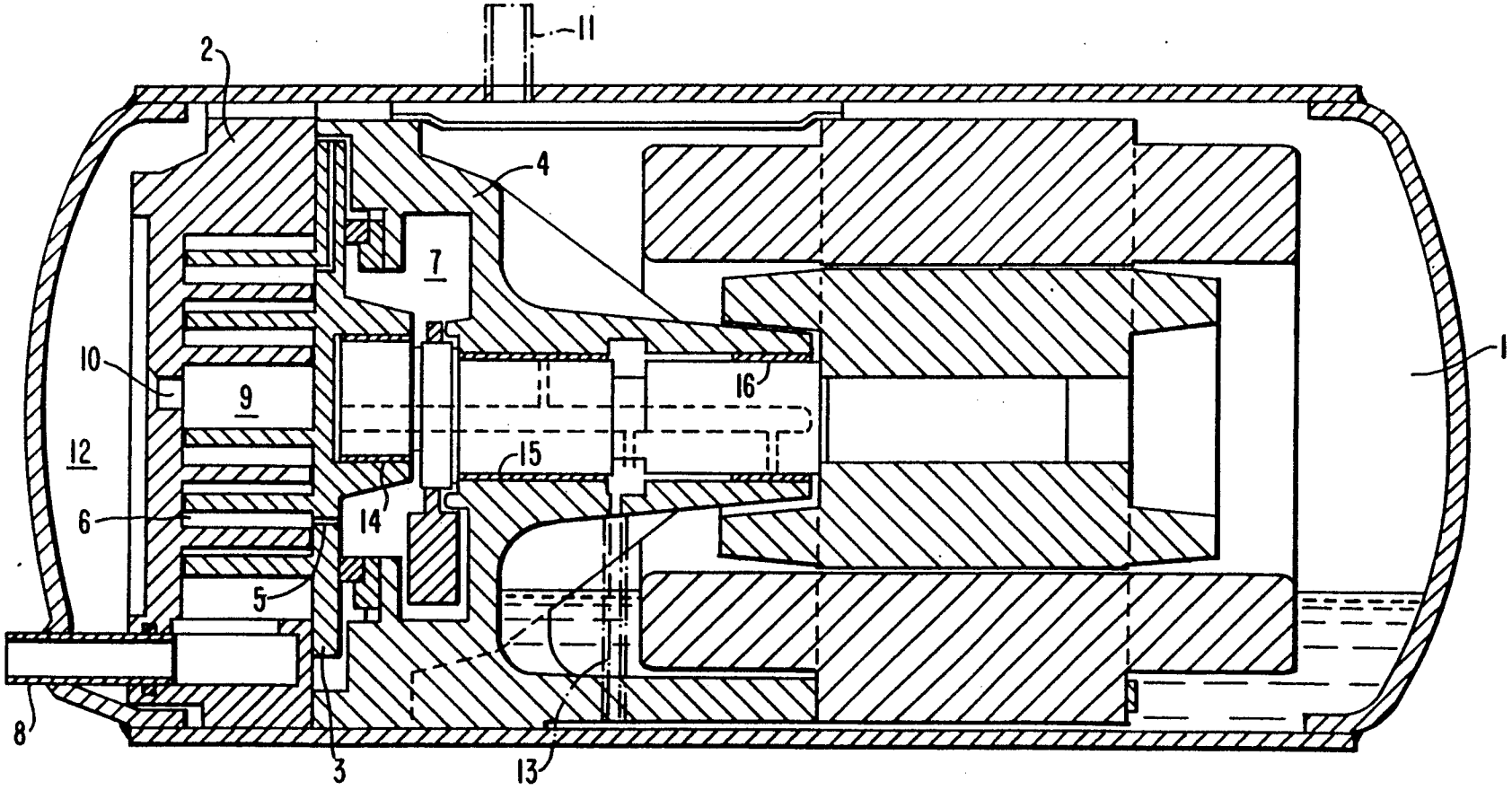
FIG. 1 PRIOR ART
FIG. 1 is a vertical longitudinal section of a scroll type compressor in accordance with the prior art.
Figure 2:
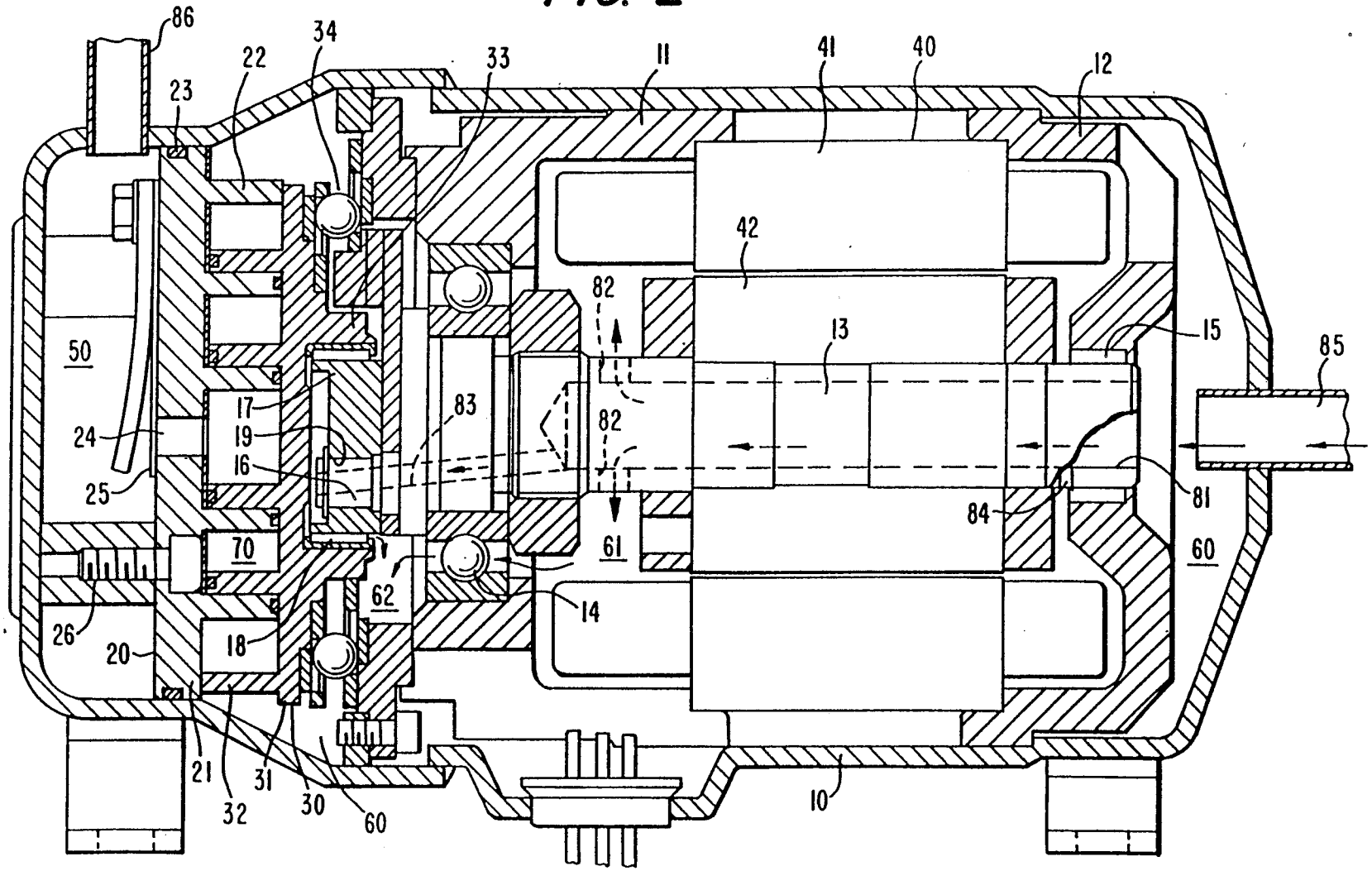
FIG. 2 is a vertical longitudinal section of a hermetically sealed scroll type compressor in accordance with a first embodiment of this invention.

Referring to FIG. 2, a hermetically sealed scroll type compressor in accordance with one embodiment of the present invention is shown. For purposes of explanation only, the left side of the Figure will be referenced as the forward end or front and the right side of the Figure will be referenced as the rearward end. The compressor includes hermetically sealed casing 10, fixed and orbiting scrolls 20, 30 and motor 40. Fixed scroll 20 includes circular end plate 21 and spiral element or wrap 22 extending from one end (rearward) surface thereof. Fixed scroll 20 is fixedly disposed within a front end portion of casing 10 by a plurality of screws 26. Circular end plate 21 of fixed scroll 20 partitions an inner chamber of casing 10 into two chambers, for example, discharge chamber 50 and suction chamber 60. O-ring seal 23 is disposed between an inner peripheral surface of casing 10 and an outer peripheral surface of circular end plate 21 to seal the mating surfaces of casing 10 and circular end plate 21.

Orbiting scroll 30 disposed within suction chamber 60 includes circular end plate 31 and spiral element or wrap 32 extending from one end (forward) surface of circular end plate 31. Spiral element 22 of fixed scroll 20 and spiral element 32 of orbiting scroll 30 interfit at an angular and radial offset to form a plurality of linear contacts which define at least one pair of sealed off fluid pockets 70. Annular projection 33 is formed at the rearward end surface of circular end plate 31 opposite spiral element 32. Rotation prevention device 34 is disposed on the outer circumferential surface of annular projection 33 to prevent rotation of orbiting scroll 30 during orbital motion.

Inner blocks 11, 12 secure stator 41 of motor 40 and are fixedly disposed near opposite ends within suction chamber 60. Drive shaft 13 axially penetrates the centers of inner blocks 11, 12. Both ends of drive shaft 13 are rotatably supported by inner blocks 11, 12 through bearings 14, 15 respectively. Motor 40 includes stator 41 and rotor 42 fixedly secured to an outer peripheral surface of drive shaft 13. Pin member 16 is integral with and axially projects from the forward end surface of drive shaft 13 and is radially offset from the axis of drive shaft 13. Bushing 17 is rotatably disposed within annular projection 33 and is supported by bearing 18. Pin member 16 is rotatably inserted in hole 19 of bushing 17 which is offset from the center of bushing 17.

Drive shaft 13 is provided with axial bore 81 and a plurality of radial bores 82. Axial bore 81 extends from an opening at a first (rearward) end of drive shaft 13, that is, the end opposite pin member 16, to a closed end rearward of pin member 16. Narrow passage 83 links the forward closed end of axial bore 81 to an open end surface of pin member 16 adjacent orbiting scroll 30. The plurality of radial bores 82 link axial bore 81 near its closed end to first cavity 61 located between motor 40 and bearing 14. A plurality of further radial bores 84 are located near the opening of axial bore 81 adjacent bearing 15. Suction gas inlet pipe 85 is inserted through the rear end of casing 10 and faces the opening of axial bore 81. Discharge gas outlet pipe 86 is attached to a side wall of casing 10 and links discharge chamber 50 to an external element.

In operation, stator 41 generates a magnetic field causing rotation of rotor 42, thereby rotating drive shaft 13. This rotation is converted to orbital motion of orbiting scroll 30 through bushing 17; rotational motion is prevented by rotation prevention drive 34. Refrigerant gas introduced into suction chamber 60 through suction gas inlet pipe 85 is taken into the outer sealed fluid pockets 70 between fixed scroll 20 and orbiting scroll 30, and moves inwardly towards the center of spiral elements 22, 32 due to the orbital motion of orbiting scroll 30. As the refrigerant moves towards the central pocket, it undergoes a resultant volume reduction and compression, and is discharged to discharge chamber 50 through discharge port 24 and one-way valve 25. Discharge gas in discharge chamber 50 then flows to an external fluid circuit (not shown) through discharge gas outlet pipe 86.

The lubricating mechanism of this embodiment operates as follows. Refrigerant gas including lubricating oil (jointly denoted refrigerant gas, hereinafter) is introduced into suction chamber 60 from suction gas inlet pipe 85, and is largely taken into axial bore 81. A large part of the refrigerant gas flows out of axial bore 81, and into first cavity 61 through radial bores 82, and then flows through a gap in bearing 14 into second cavity 62 on the opposite side of bearing 14, rearward of rotation prevention device 34. The remainder of the refrigerant gas in axial bore 81 flows through narrow passage 83 and into the gap between bushing 17 and annular projection 33. The gas then flows through a gap in bearing 18, and into second cavity 62. Subsequently, refrigerant gas in second cavity 62 flows through rotation prevention device 34, before being taken into sealed fluid pockets 70. Thus, refrigerant gas effectively flows to lubricate bearing 14, bearing 18 and rotation prevention device 34. Additionally, some lubricant oil is partly separated from the refrigerant gas and remains beneath orbiting scroll 30, while some of the lubricant is taken into sealed fluid pockets 70 as a mist due to orbital motion of orbiting scroll 30. Finally, some of the refrigerant gas flows through the plurality of radial bores 84 to further lubricate bearing 15.

Figure 3:
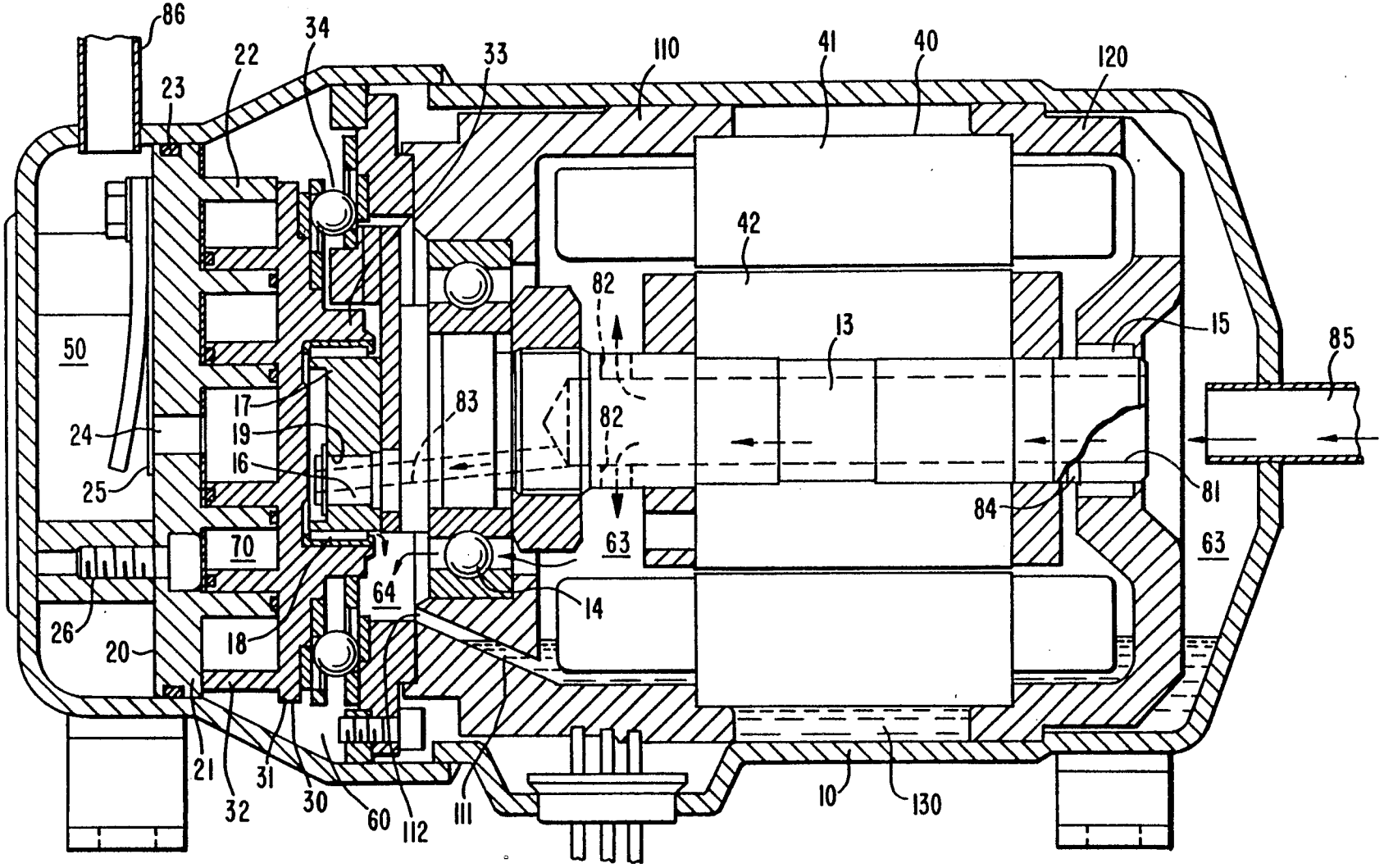
FIG. 3 is a vertical longitudinal section of a hermetically sealed scroll type compressor in accordance with a second embodiment of this invention.

Referring to FIG. 3, a hermetically sealed scroll type compressor in accordance with a second embodiment of the present invention is shown. The same construction is accorded like numerals as shown with respect to FIG. 2 and the description of some of the identical elements is substantially omitted.

Inner blocks 110 and 120 securing stator 41 of motor 40 are fixedly disposed within suction chamber 60. Drive shaft 13 axially penetrates the center of inner blocks 110 and 120. Inner block 110 may be disposed perpendicularly to the axis of rotation of drive shaft 13. Both ends of drive shaft 13 are rotatably supported by inner blocks 110 and 120 through bearings 14 and 15. The axis of rotation of the drive shaft is disposed parallel to a level surface on which the compressor is mounted. Inner block 110 divides suction chamber 60 into first suction chamber section 63 rearward of inner block 110 in which motor 40 is located and second suction chamber section 64 forward of inner block 110 in which orbiting scroll 30 and rotation prevention mechanism 34 are located. Inclined passage 111 links first and second suction chamber sections 63, 64 and is formed at a lower part of inner block 110. Inclined hole 111 extends upwardly from first suction chamber 63 towards second suction chamber section 64.

The lubricating mechanism of this embodiment operates as follows. Refrigerant gas including lubricating oil is introduced into first suction chamber section 63 and is mostly taken into axial bore 81. However, a large part of the refrigerant gas flows into first suction chamber section 63 from axial bore 81 through a plurality of radial bores 82 and 84 so that lubricating oil is separated from the refrigerant gas due to centrifugal forces and particle interactions and settles at the bottom of first suction chamber section 63. Subsequently, refrigerant gas flows into second suction chamber section 64 through the gap of bearing 14 so that a small pressure difference is created between first and second suction chambers sections 63 and 64. The pressure of second suction chamber section 64 is lower than the pressure of first suction chamber section 63. Accordingly, lubricating oil 130 settled at the bottom of first suction chamber section 63 flows to second suction chamber section 64 through inclined passage 111 to lubricate rotation preventing mechanism 34 and a contact portion between fixed and orbiting scrolls 20, 30.

Furthermore, the open end of inclined passage 111 formed at the second suction chamber section side is located at a position which is higher than the uppermost level of lubricating oil 130 in the bottom of first suction chamber section 63 to prevent an overflow of settled lubricating oil 130 to the scrolls when the compressor is re-started after not operating for a long period of time. Therefore, damage to the scrolls is prevented.

This invention has been described in detail in connection with preferred embodiments. These embodiments, however, are merely for example only and the invention is not restricted thereto. It will be understood by those skilled in the art that other variations and modifications can easily be made within the scope of this invention as defined by the appended claims.

We claim:

1. A method of lubricating a scroll type compressor, the compressor comprising a fixed scroll disposed within said housing and having a first end plate and a first spiral element extending therefrom, said first end plate of said fixed scroll dividing said housing into a discharge chamber and a suction chamber into which said first spiral element extends, an orbiting scroll having a second end plate and a second spiral element extending therefrom, said first and second spiral elements interfitting at an angular and radial offset to form a plurality of line contacts which define at least one pair of sealed off fluid pockets, a drive mechanism operatively connected to said orbiting scroll to effect orbital motion of said orbiting scroll, rotation prevention means for preventing the rotation of said orbiting scroll during orbital motion whereby the volume of said fluid pockets changes to compress fluid in the pockets, said method of lubricating comprising the steps of:

providing a dividing wall to divide said suction chamber into first and second sections;

separating lubricating oil from a mixture of refrigerant gas and lubricating oil in said first section of said suction chamber;

providing an inclined passage in said dividing wall to link said first section of said suction chamber to said second section of said suction chamber; and creating a pressure differential between said first section of said suction chamber and said second section of said suction chamber, wherein said separated lubricating oil flows through said inclined passage due to the pressure differential to lubricate said compressor.

2. The method recited in claim 1, said rotation prevention means disposed within said second section, said lubricating oil flowing through said inclined passage and lubricating said rotation prevention means.

3. In a scroll type compressor with a hermetically sealed housing, the compressor comprising a fixed scroll disposed within said housing and having a first end plate and a first spiral element extending therefrom, said first end plate of said fixed scroll dividing said housing into a discharge chamber and a suction chamber into which said first spiral element extends, an orbiting scroll having a second end plate and a second spiral element extending therefrom, said first and second spiral elements interfitting at an angular and radial offset to form a plurality of line contacts which define at least one pair of sealed off fluid pockets, a drive mechanism operatively connected to said orbiting scroll to effect orbital motion of said orbiting scroll, the axis of rotation of said drive mechanism disposed substantially horizontally when said compressor is disposed on a horizontal surface, rotation prevention means for preventing the rotation of said orbiting scroll during orbital motion whereby the volume of said fluid pockets changes to compress fluid in the pockets, the improvement comprising:

said suction chamber being divided into first and second suction chamber sections by a partition wall, said fixed and orbiting scrolls and said rotation prevention means disposed within said second suction chamber section, said drive mechanism disposed within said first suction chamber section, a refrigerant gas inlet port disposed in said housing at said first suction chamber section, an inclined passage linking said first and second suction chamber sections formed in a lower part of said partition wall, said inclined passage inclined upwardly from said first suction chamber section to said second suction chamber section, wherein lubricating oil separated from refrigerant gas settles at the bottom of said first suction chamber section.

4. The hermetically sealed scroll type compressor of claim 3 wherein said drive mechanism includes a motor supported in said housing, said motor including a rotor secured to said drive shaft.

5. The hermetically sealed scroll type compressor of claim 3 wherein a drive shaft of said drive mechanism is rotatably supported through said partition wall by a bearing.

6. The hermetically sealed scroll type compressor of claim 3 wherein one open end of said inclined passage formed at said second suction chamber section side is located at a higher level than the uppermost limit level of the surface of said lubricating oil.

7. The hermetically sealed scroll type compressor of claim 3 wherein said partition wall is disposed perpendicularly to said axis of rotation of said drive mechanism.

8. The compressor recited in claim 3 further comprising:

supporting means for rotatably supporting said driving mechanism within said partition wall, said supporting means including a gap, said refrigerant gas flowing from said first suction chamber section to said second suction chamber section through said gap to create a higher pressure in said first section than in said second section, said separated lubricating oil flowing through said inclined passage due to the difference in pressure to lubricate said compressor.

9. The compressor recited in claim 8, said rotation prevention means disposed within said second section at a position adjacent one end of said inclined passage, said lubricating oil flowing through said passage to lubricate said rotation prevention means.

10. In a scroll type compressor comprising a fixed scroll disposed within said housing and having a first end plate and a first spiral element extending therefrom, said first end plate of said fixed scroll dividing said housing into a discharge chamber and a suction chamber into which said first spiral element extends, an orbiting scroll having a second end plate and a second spiral element extending therefrom, said first and second spiral elements interfitting at an angular and radial offset to form a plurality of line contacts which define at least one pair of sealed off fluid pockets, a drive mechanism including a drive shaft operatively connected to said orbiting scroll to effect orbital motion of said orbiting scroll, said drive shaft disposed substantially horizontally when said compressor is disposed on a horizontal surface, rotation prevention means for preventing the rotation of said orbiting scroll during orbital motion whereby the volume of said fluid pockets changes to compress fluid in the pockets, the improvement comprising:

partition means for partitioning said suction chamber into first and second sections, said partition means including an inclined passage linking said first section of said suction chamber to said second section of said suction chamber;

separating means for separating lubricating oil from a mixture of refrigerant gas and lubricating oil in said first section of said suction chamber;

pressure differential creating means for creating a higher pressure in said first section of said suction chamber than in said second section of said suction chamber, said separated lubricating oil flowing through said inclined passage due to the pressure differential to lubricate said compressor.

11. The compressor recited in claim 10, said drive shaft including an axial bore, said separating means comprising a plurality of radial bores formed through said drive shaft and linked to said axial bore, refrigerant gas flowing into said axial bore and out of said radial bores such that lubricating oil is separated from the refrigerant gas and settles in said first section of said suction chamber.

* * * * *

UNITED STATES PATENT AND TRADEMARK OFFICE

CERTIFICATE OF CORRECTION

PATENT NO. : 5,000,669

DATED : March 19, 1991

INVENTOR(S) : Shigemi Shimizu and Kazuto Kikuchi

It is certified that error appears in the above-identified patent and that said Letters Patent is hereby corrected as shown below:

ON TITLE PAGE: Section [54], delete "SECTION" and insert --SUCTION--.

Signed and Sealed this

Fourth Day of August, 1992

*Attest:*

DOUGLAS B. COMER

*Attesting Officer*

*Acting Commissioner of Patents and Trademarks*